US007557733B1

(12) United States Patent
Bieberdorf

(10) Patent No.: US 7,557,733 B1
(45) Date of Patent: Jul. 7, 2009

(54) AIRFIELD LIGHTING SYSTEM WITH REGULATOR SELECTOR

(76) Inventor: Roger Bieberdorf, 3060 N. Ridgecrest, #115, Mesa, AZ (US) 85207

( * ) Notice: Subject to any disclaimer, the term of this patent is extended or adjusted under 35 U.S.C. 154(b) by 364 days.

(21) Appl. No.: 11/567,303

(22) Filed: Dec. 6, 2006

(51) Int. Cl.
*G08B 21/00* (2006.01)

(52) U.S. Cl. ..... 340/945; 340/947; 362/559; 701/3

(58) Field of Classification Search ..... 340/642
See application file for complete search history.

(56) References Cited

U.S. PATENT DOCUMENTS 3,710,157 A 1/1973 Wright
4,323,841 A 4/1982 Jacobsen
5,426,429 A 6/1995 Norman et al.
5,485,151 A 1/1996 Runyon et al.
5,926,115 A * 7/1999 Schleder et al. ..... 340/953
5,969,642 A * 10/1999 Runyon et al. ..... 340/953
6,573,840 B1 6/2003 Norman et al.
7,088,263 B1 * 8/2006 Krause et al. ..... 340/947
2001/0038345 A1 11/2001 Satoh et al.
2003/0160707 A1 * 8/2003 Norman et al. ..... 340/953

* cited by examiner

*Primary Examiner*—Daniel Wu
*Assistant Examiner*—John F Mortell
(74) *Attorney, Agent, or Firm*—Parsons & Goltry; Michael W. Goltry; Robert A. Parsons

(57) ABSTRACT

An airfield series circuit includes a transfer relay having first and second sides, and a primary regulator operatively coupled to an airfield series loop of an airfield at the first side of the transfer relay. A standby regulator is operatively coupled to the airfield series circuit at the second side of the transfer relay. The transfer relay is movable between a primary mode of operation whereby the first side of the transfer relay closed directing lighting power to the airfield series loop from the primary regulator and the second side of the transfer relay open isolating the standby regulator from the airfield series circuit, and a standby mode of operating whereby the second side of the transfer relay closed directing lighting power to the airfield series loop from the standby regulator and the first side of the transfer relay open isolating the primary regulator from the airfield series circuit.

19 Claims, 6 Drawing Sheets

AIRFIELD LIGHTING SYSTEM WITH REGULATOR SELECTOR

FIELD OF THE INVENTION

The present invention relates to airfield lighting systems.

BACKGROUND OF THE INVENTION

Numerous airport visual aids are available to provide information and guidance to pilots maneuvering on airports. These aids may consist of single units or complex systems composed of many parts. Often visual aids have different performance requirements and configurations, but may share common installation procedures. For example, installation procedures for in-pavement lighting systems are essentially the same, yet the lighting systems may perform different functions. Examples of airport visual aids include runway centerline and edge lighting systems, taxiway centerline and edge lighting systems, touchdown zone lighting systems, runway guard lights, stop bars, threshold lights, and clearance bars.

There are generally two types of circuits used to power airport lighting systems, namely, series powered circuits and parallel powered circuits. Series powered circuits are recommended for most lighting systems, particularly high intensity runway lights (HIRLs), medium intensity runway lights (MIRLs), and medium intensity taxiway lights (MITLs). Parallel circuits are often used to power low intensity runway lights (LIRLs) and various visual landing aids such as precision approach path indicators (PAPIs) and runway end identifier lights (REILs), but may also be used with MIRLs or MITLs.

Series powered airport lighting circuits are more commonly used than parallel circuits and are powered by constant current regulators (CCRs). In a series powered airport lighting circuit, a series plug cutout (SPC) may be is installed at the CCR output through which a airfield series circuit passes, and to the airfield series loop which supports the lighting components of the designated lighting system. The SPC is used to isolate the CCR output from the airfield series loop for maintenance personnel safety, and when the plug cut out is removed shorts the series loop and the CCR. The CCR and the associated SPC servicing each airfield series loop are typically housed in a vault, and are controlled locally, such as with a control panel, or remotely, such as from a remote monitoring station and control panel/system.

CCRs must undergo periodic servicing in the nature of maintenance, repair, or replacement. A CCR must be deactivated before it may be serviced. When a CCR is deactivated, the series loop it services is also deactivated, which requires the area of the airfield serviced by the lighting components associated with the series loop to be closed until the airfield series circuit is re-activated. Closing portions of airport airfields for the purpose of servicing CCRs is costly, inconvenient, and unsafe, particularly at high-traffic airports. Accordingly, what is needed is a system and method whereby a CCR may be periodically taken offline for servicing purposes without rendering inoperative the series loop it services.

SUMMARY OF THE INVENTION

According to the invention, an airfield lighting system consists of an airfield series circuit including a transfer relay having first and second sides, and a primary regulator operatively coupled to an airfield series loop of an airfield at the first side of the transfer relay. A standby regulator is operatively coupled to the airfield series circuit at the second side of the transfer relay. The transfer relay is movable between primary and standby modes of operation. The primary mode of operation consists of the first side of the transfer relay closed directing lighting power to the airfield series loop from the primary regulator, and the second side of the transfer relay open isolating the standby regulator from the airfield series circuit. The standby mode of operation consists of the second side of the transfer relay closed directing lighting power to the airfield series loop from the standby regulator, and the first side of the transfer relay open isolating the primary regulator from the airfield series circuit. A series plug cutout is coupled to the airfield series circuit between the transfer relay and the airfield series loop. A cabinet houses the primary and standby regulators, the transfer relay, and the series plug cutout. A control system is operatively coupled to the transfer relay, and is used to moving the transfer relay between the primary and standby modes of operation. Preferably, the cabinet is located at an installation site adjacent to the airfield.

According to the principle of the invention, an airfield lighting system consists of a first airfield series circuit including a first transfer relay having first and second sides, and a first primary regulator operatively coupled to a first airfield series loop of an airfield at the first side of the first transfer relay. Further to the present embodiment is a second airfield series circuit including a second transfer relay having first and second sides, and a second primary regulator operatively coupled to a second airfield series loop of the airfield at the first side of the second transfer relay. A standby regulator is operatively coupled to the first airfield series circuit at the second side of the first transfer relay, and to the second airfield series circuit at the second side of the second transfer relay. The transfer relay is movable between primary and standby modes of operation respecting the first and second airfield series circuits. With respect to the first airfield series circuit the primary mode of operation of the transfer relay is the first side of the first transfer relay closed directing lighting power to the first airfield series loop from the first primary regulator and the second side of the first transfer relay open isolating the standby regulator from the first airfield series circuit, and the standby mode of operation is the second side of the first transfer relay closed directing lighting power to the first airfield series loop from the standby regulator and the first side of the first transfer relay open isolating the first primary regulator from the first airfield series circuit. With respect to the second airfield series circuit the primary mode of operation is the first side of the second transfer relay closed directing lighting power to the second airfield series loop from the second primary regulator and the second side of the second transfer relay open isolating the standby regulator from the second airfield series circuit, and the standby mode of operation is the second side of the second transfer relay closed directing lighting power to the second airfield series loop from the standby regulator and the first side of the second transfer relay open isolating the second primary regulator from the second airfield series circuit. A first series plug cutout is coupled to the first airfield series circuit between the first transfer relay and the first airfield series loop. A second series plug cutout is coupled to the second airfield series circuit between the second transfer relay and the second airfield series loop. A cabinet houses the first and second primary regulators, the standby regulator, the first and second transfer relays, and the first and second series plug cutouts. A control system operatively coupled to the first and second transfer relays is provided for moving the first and second transfer relays between the primary and standby modes of operation, respectively. Preferably, the cabinet is located at an installation site adjacent to the airfield.

According to the principle of the invention, a method consists of providing an airfield series circuit including a transfer relay having first and second sides and movable between primary and standby modes of operation, and a primary regulator operatively coupled to an airfield series loop of an airfield at the first side of the transfer relay. The method further includes providing a standby regulator, and operatively coupling the standby regulator to the airfield series circuit at the second side of the transfer relay, whereby the primary mode of operation is the first side of the transfer relay closed directing lighting power to the airfield series loop from the primary regulator and the second side of the transfer relay open isolating the standby regulator from the airfield series circuit, and the standby mode of operation is the second side of the transfer relay closed directing lighting power to the airfield series loop from the standby regulator and the first side of the transfer relay open isolating the primary regulator from the airfield series circuit. In one embodiment, the method further includes placing the transfer relay in the primary mode of operation directing lighting power to the airfield series loop from the primary regulator and isolating the standby regulator from the airfield series circuit. In another embodiment, the method further includes placing the transfer relay in the standby mode of operation directing lighting power to the airfield series loop from the standby regulator and isolating the primary regulator from the airfield series circuit, servicing the primary regulator, completing the step of servicing the primary regulator, and placing the transfer relay in the primary mode of operation directing lighting power to the airfield series loop from the primary regulator and isolating the standby regulator from the airfield series circuit. The method further includes providing a series plug cutout, and coupling the series plug cutout coupled to the airfield series circuit between the transfer relay and the airfield series loop. In a particular embodiment, the method also includes providing a cabinet, and housing the primary and standby regulators, the transfer relay, and the series plug cutout in the cabinet, and installing the cabinet at an installation site adjacent to the airfield.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION OF PREFERRED EMBODIMENTS

Figure 1:
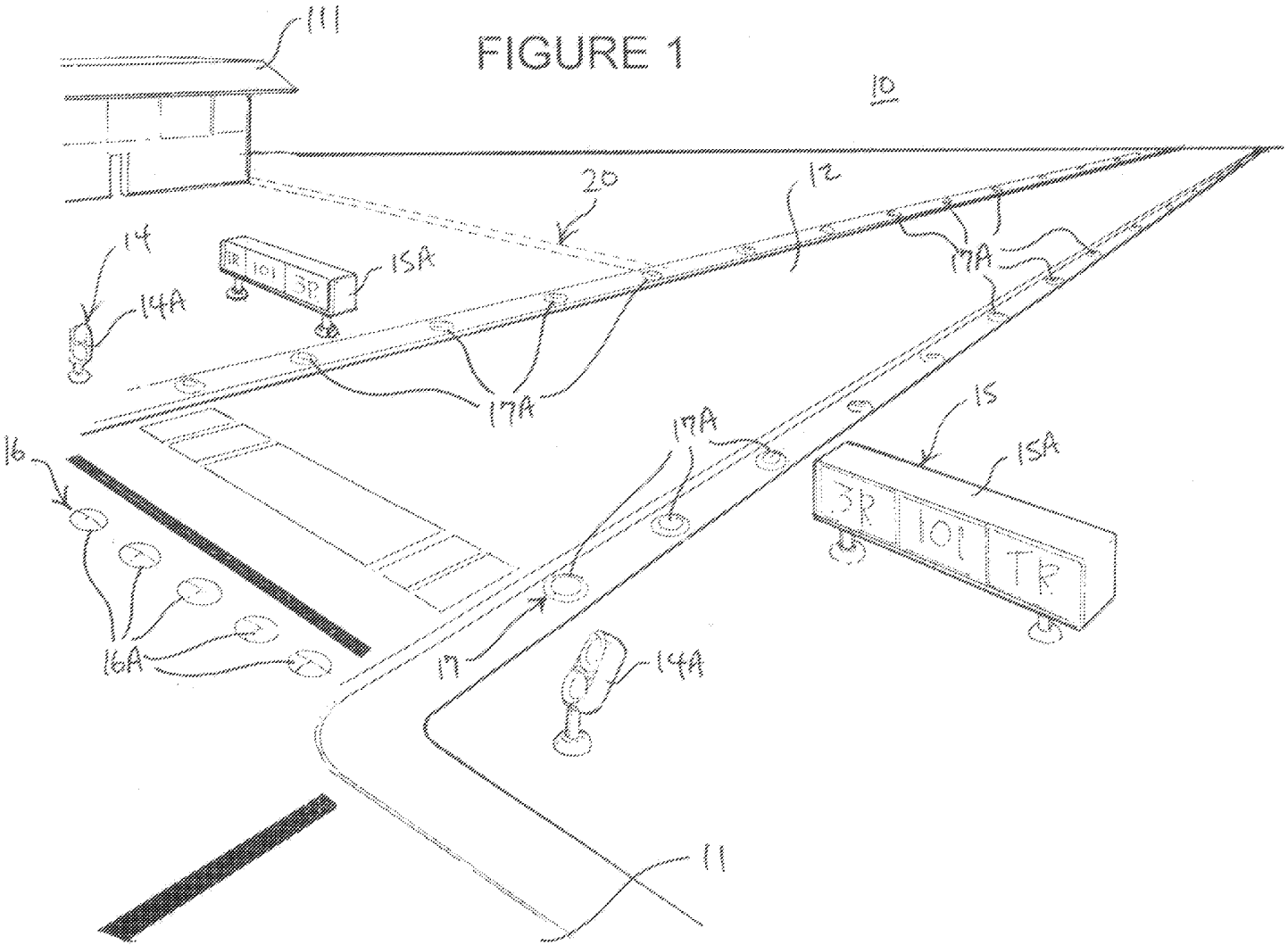
FIG. 1 is a highly generalized partially schematic perspective view of an airfield incorporating an airfield lighting system constructed and arranged in accordance with the principle of the invention.

Turning now to the drawings, in which like reference characters indicate corresponding elements throughout the several views, attention is first directed to FIG. 1 in which there is seen a highly generalized partially schematic perspective view of an airport or airfield 10 incorporating an airfield lighting system 20 constructed and arranged in accordance with the principle of the invention. Airfield 10 is a place provided for the arrival and departure of aircraft, usually providing refueling, maintenance, repair, storage, and other facilities. In FIG. 1, airfield 10 is shown having a taxiway 11 leading to a runway 12, each of which may be referred to as an airfield traffic way. Taxiway 11 is used for the taxiing of aircraft to and from runway 12, and runway 12 is used for the landing and takeoff of aircraft.

Airfield 10 incorporates numerous visual aids, forming part of airfield lighting system 20, to provide information and guidance to pilots maneuvering thereon. The visual aids denoted in FIG. 1 include, as a matter of example, a wig-wag light visual aid 14 including wig-wag light components 14A on either side of runway 12, a guidance sign visual aid 15 including guidance light components 15A on either side of runway 12, a threshold light visual aid 16 including a threshold bar formed by in-ground threshold light components 16A incorporated with runway 12, and a runway edge light visual aid 17 including runway edge lighting formed by in-ground runway edge light components 17A incorporated in conjunction with runway 12, whereby each of the visual aids constitute a particular type of visual aid to provide a specific type of information and guidance to pilots maneuvering on airfield 10. Each type of visual aid is powered by a corresponding airfield series powered circuit or series circuit or voltage circuit. For instance, wig-wag light components 14A are powered by a wig-wag sign series circuit, guidance sign light components 15A are powered by a guidance sign series circuit, or connected to a runway or taxiway circuit, threshold light components 16A are powered by a threshold light series circuit, or connected to a runway series circuit, and runway edge light components 17A are powered by a runway edge light series circuit.

The visual aids referenced in FIG. 1 are but a few of the many visual aids airport 10 may incorporate, whereby others may include a runway centerline lighting system including runway centerline light components powered by a runway centerline lighting circuit, a taxiway centerline lighting system including taxiway centerline light components powered by a taxiway centerline lighting circuit, a taxiway edge lighting system including taxiway edge light components powered by a taxiway edge light circuit, a touchdown zone lighting system including touchdown zone light components powered by a touchdown zone light circuit, a clearance bar light system including clearance bar light components powered by a clearance bar light circuit, and the like. Airfield 10 may incorporate any number of runways, taxiways and other forms of airfield traffic ways, and any number of corresponding visual aids. Furthermore, airfield 10 is generally representative of a typical airfield or airport, and the visual aids referenced in connection with airfield 10 are normal of those found at most airfields or airports.

It is to be understood that the various components of airfield 10 are set forth very generally merely for illustrative purposes in conjunction with the ensuing discussion of the invention, and are not intended to represent an actual airfield. The arrangement and visual appearance of the various components of airfield 10 including the illustration of the visual aids as discussed above are not intended to be entirely accurate, but are merely set forth in a highly generalized fashion for illustrating the various visual aids that a typical airfield incorporates in order to provide a foundation for the ensuing discussion of the invention.

Figure 2:
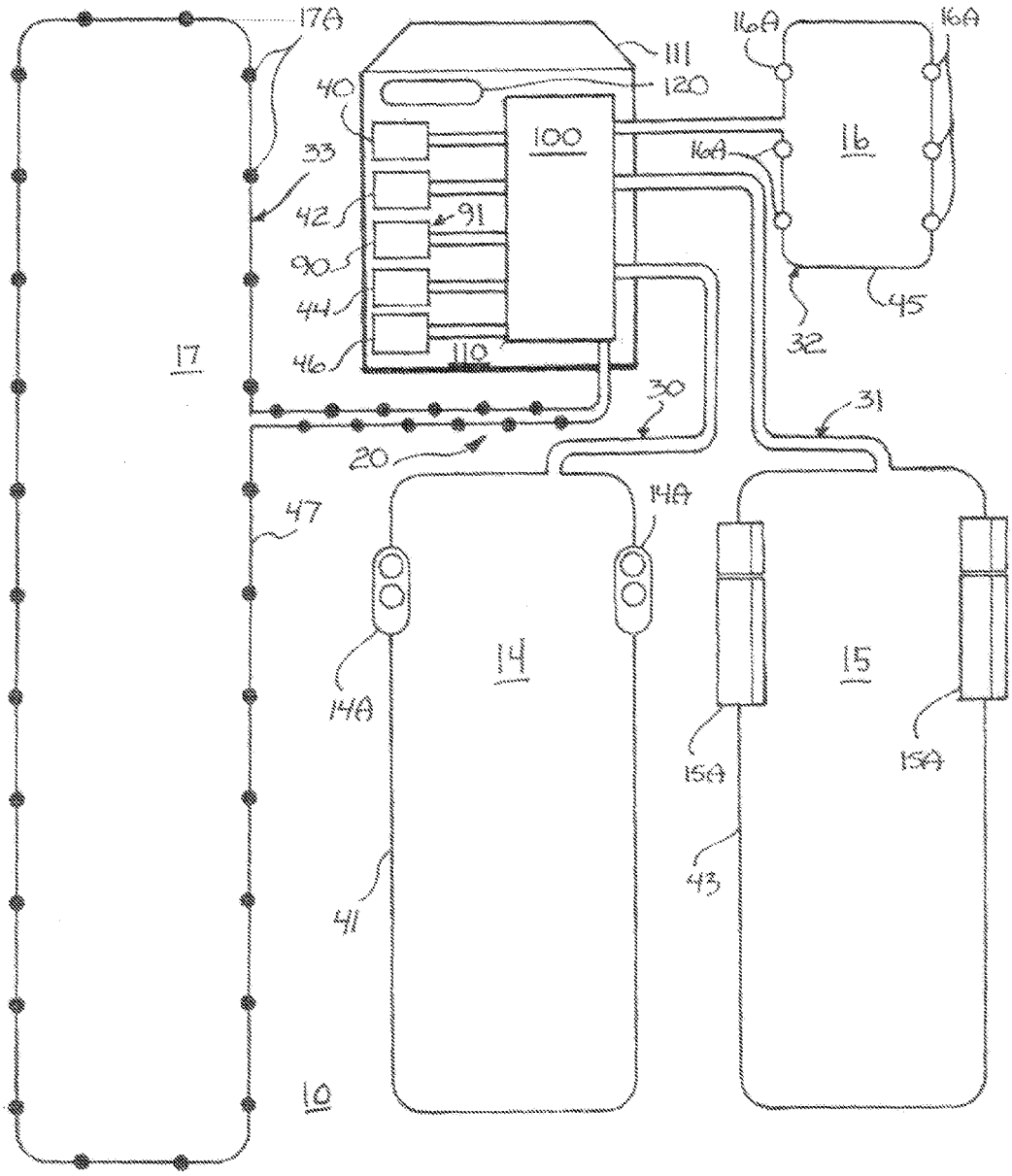
FIG. 2 is a schematic representation of the airfield lighting system of FIG. 1.

Referring now to FIG. 2, there is seen a schematic representation of lighting system 20, which is constructed and arranged in accordance with the principle of the invention. Lighting system 20 consists of a plurality of airfield series circuits each used to power a particular type of visual aid, whether a wig-wag sign visual aid, a guidance sign visual aid, a threshold light visual aid, a runway edge lighting visual aid, or other visual aid. In FIG. 2, four series circuits 30-33 are illustrated, each of which power a different visual aid. As a matter of example, series circuit 30 powers wig-wag sign visual aid 14, series circuit 31 powers guidance sign visual aid 15, series circuit 32 powers threshold light visual aid 16, and series circuit 33 powers runway edge light visual aid 17.

Figure 3:
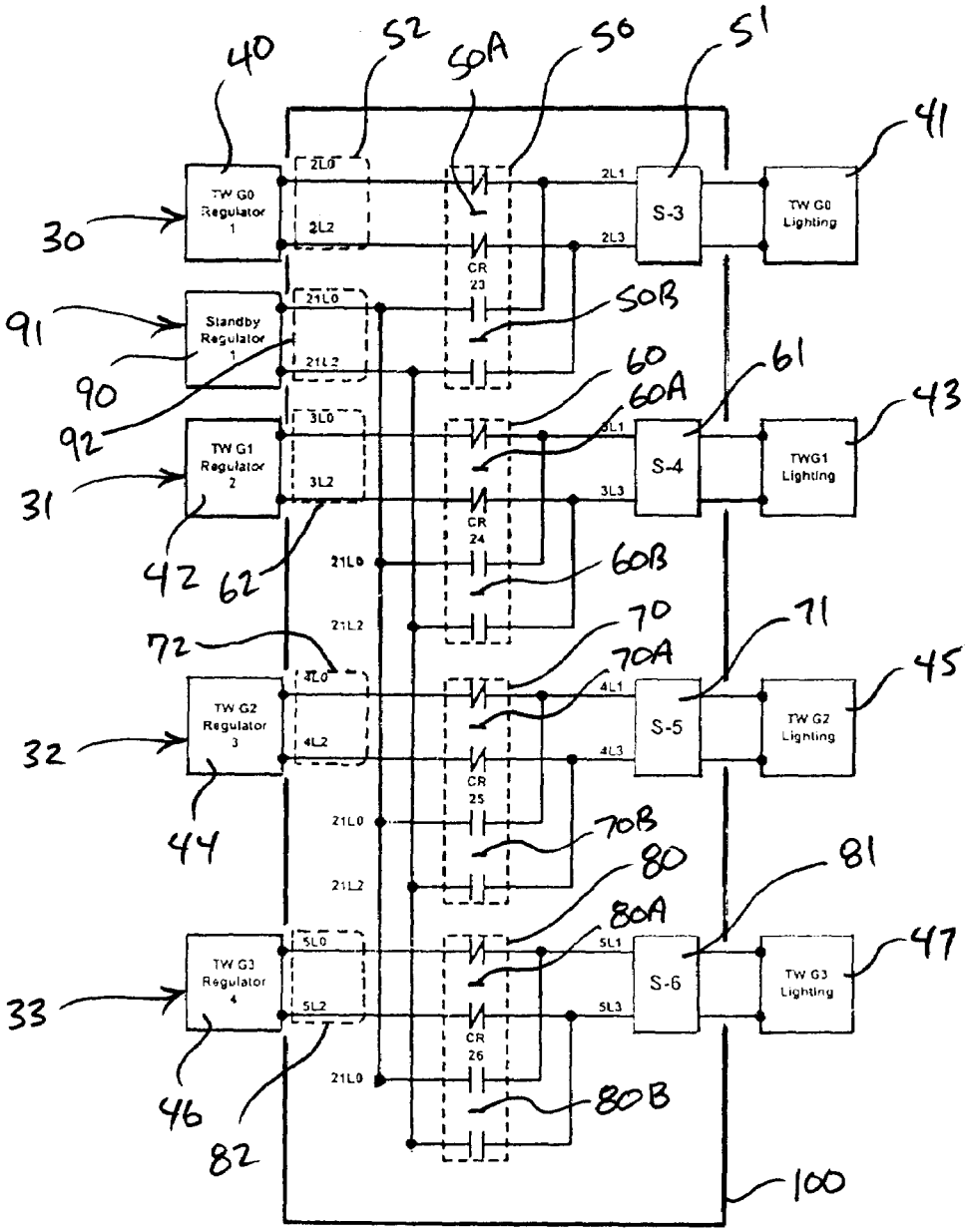
FIG. 3 is a schematic representation of airfield series circuits of the airfield lighting system of FIG. 1.

Series circuit 30 consists of a primary constant current regulator (CCR) 40 that powers/services airfield series loop 41 servicing wig-wag light components 14A, series circuit 31 consists of a primary CCR 42 that powers/services airfield series loop 43 servicing guidance sign light components 15A, series circuit 32 consists of a primary CCR 44 that powers/services airfield series loop 45 servicing threshold light components 16A, and series circuit 33 consists of a primary CCR 46 that powers/services airfield series loop 47 servicing runway edge light components 17A. The terms "regulator" and "CCR" are interchangeable each referring to a constant current regulator. Series circuits 30-33 are installed in conjunction with a series of circuit appliances, which are disposed between the CCRs and the series loops they service. FIG. 3 is a schematic representation of series circuits 30-33 of lighting system 20.

Series circuit 30 is formed by a transfer relay 50 having opposed sides 50A and 50B, and primary regulator 40 operatively coupled to airfield series loop 41 at side 50A of transfer relay 50. Series circuit 30 passes through side 50A of transfer relay 50, and side 50A of transfer relay 50 is installed at the output of primary regulator 40. Series circuit 30 passes through a terminal block 52 between side 50A of transfer relay 50 and the output of primary regulator 40. Terminal block 52 provides a connection point between primary regulator 40 and side 50A of transfer relay 50. A series plug cutout (SPC) 51 is coupled to series circuit 30 between transfer relay 50 and airfield series loop 41, whereby series circuit 30 passes through SPC 51. SPC 51 is conventional, and, like any conventional SPC is used to isolate the output of primary regulator 40 from airfield series loop 41 for maintenance personnel safety, and shorts airfield series loop 41.

Series circuit 31 is formed by a transfer relay 60 having opposed sides 60A and 60B, and primary regulator 42 operatively coupled to airfield series loop 43 at side 60A of transfer relay 60. Series circuit 31 passes through side 60A of transfer relay 60, and side 60A of transfer relay 60 is installed at the output of primary regulator 42. Series circuit 31 passes through a terminal block 62 between side 60A of transfer relay 60 and the output of primary regulator 42. Terminal block 62 provides a connection point between primary regulator 40 and side 50A of transfer relay 50. A series plug cutout (SPC) 61 is coupled to series circuit 31 between transfer relay 60 and airfield series loop 43, whereby series circuit 31 passes through SPC 61. SPC 61 is conventional, and, like any conventional SPC, is used to isolate the output of primary regulator 42 from airfield series loop 43 for maintenance personnel safety, and shorts airfield series loop 43.

Series circuit 32 is formed by a transfer relay 70 having opposed sides 70A and 70B, and primary regulator 44 operatively coupled to airfield series loop 45 at side 70A of transfer relay 70. Series circuit 32 passes through side 70A of transfer relay 70, and side 70A of transfer relay 70 is installed at the output of primary regulator 44. Series circuit 32 passes through a terminal block 72 between side 70A of transfer relay 70 and the output of primary regulator 44. Terminal block 72 provides a connection point between primary regulator 44 and side 70A of transfer relay 70. A series plug cutout (SPC) 71 is coupled to series circuit 32 between transfer relay 70 and airfield series loop 45, whereby series circuit 32 passes through SPC 71. SPC 71 is conventional, and, like any conventional SPC is used to isolate the output of primary regulator 44 from airfield series loop 45 for maintenance personnel safety, and shorts airfield series loop 45.

Series circuit 33 is formed by a transfer relay 80 having opposed sides 80A and 80B, and primary regulator 46 operatively coupled to airfield series loop 47 at side 80A of transfer relay 80. Series circuit 33 passes through side 80A of transfer relay 80, and side 80A of transfer relay 80 is installed at the output of primary regulator 46. Series circuit 33 passes through a terminal block 82 between side 80A of transfer relay 80 and the output of primary regulator 46. Terminal block 82 provides a connection point between primary regulator 46 and side 80A of transfer relay 80. A series plug cutout (SPC) 81 is coupled to series circuit 33 between transfer relay 80 and airfield series loop 46, whereby series circuit 33 passes through SPC 81. SPC 81 is conventional, and, like any conventional SPC is used to isolate the output of primary regulator 46 from airfield series loop 47 for maintenance personnel safety, and shorts airfield series loop 47.

Lighting system 20 incorporates a standby CCR 90. Standby regulator 90 is operatively coupled to series circuit 30 at side 50B of transfer relay 50, to series circuit 31 at side 60B of transfer relay 60, to series circuit 32 at side 70B of transfer relay 70, and to series circuit 33 at side 80B of transfer relay 80, in accordance with the principle of the invention, with a standby series circuit 91. Standby series circuit 91 passes through a terminal block 92 between sides 50B, 60B, 70B, and 80B of transfer relays 50, 60, 70, and 80 and the output of standby regulator 90. Terminal block 92 provides a connection point between standby regulator 90 and sides 50B, 60B, 70B, and 80B of transfer relays 50, 60, 70, and 80.

With respect to series circuit 30, transfer relay 50 is movable between primary and standby modes of operation. The primary mode of operation of transfer relay 50 is side 50A of transfer relay 50 closed directing lighting power to airfield series loop 41 from primary regulator 40, and side 50B of transfer relay 50 open isolating standby regulator 90 from series circuit 41 and airfield series loop 41. The standby mode of operation of transfer relay 50 is side 50B of transfer relay 50 closed directing lighting power to airfield series loop 41 from standby regulator 90, and side 50A of transfer relay 50 open isolating primary regulator 40 from airfield series loop 41. In the standby mode of operation of transfer relay 50, standby regulator 90 directs lighting power to airfield series loop 41 allowing primary regulator 40 to be serviced without interrupting the operation of series loop 41. After servicing of primary regulator 40 is completed, transfer relay 50 may be moved from its standby mode of operation back to its primary mode of operation transferring lighting power to airfield series loop 41 from standby regulator 90 back to primary regulator 40. The foregoing operation of standby regulator 90 in conjunction with series circuit 30 is the same for series circuits 31-33, but will, nevertheless, be discussed.

Transfer relay 50 is conventional and is movable between two conditions of operation, whereby in the first condition side 50A is closed and side 50B is open, and in the second condition side 50A is open and side 50B is closed. Like any conventional transfer relay, transfer relay 50 incorporates a magnetic coil. To set transfer relay 50 in its first condition, which corresponds to the primary mode of operation of transfer relay 50 in conjunction with lighting system 20, the polarity across a magnetic coil of transfer relay 50 is set such that side 50A is closed and side 50B is open. To move transfer relay 50 from its first condition to its second condition corresponding to the standby mode of operation of transfer relay 50 in conjunction with lighting system 20, the polarity across a magnetic coil of transfer relay 50 is changed opening side 50A and closing side 50B. To move transfer relay 50 from its second condition back to its first condition corresponding to the primary mode of operation of transfer relay 50 in conjunction with lighting system 20, the polarity across a magnetic coil of transfer relay 50 is changed closing side 50A and opening side 50B. Further details of transfer relay 50 will readily occur to the skilled artisan and will not be discussed.

With respect to series circuit 31, transfer relay 60 is movable between primary and standby modes of operation. The primary mode of operation of transfer relay 60 is side 60A of transfer relay 60 closed directing lighting power to airfield series loop 43 from primary regulator 42, and side 60B of transfer relay 60 open isolating standby regulator 90 from series circuit 31 and airfield series loop 43. The standby mode of operation of transfer relay 60 is side 60B of transfer relay 60 closed directing lighting power to airfield series loop 43 from standby regulator 90, and side 60A of transfer relay 60 open isolating primary regulator 42 from airfield series loop 43. In the standby mode of operation of transfer relay 60, standby regulator 90 directs lighting power to airfield series loop 43 allowing primary regulator 42 to be serviced without interrupting the operation of series loop 43. After servicing of primary regulator 42 is completed, transfer relay 60 may be moved from its standby mode of operation back to its primary mode of operation transferring lighting power to airfield series loop 43 from standby regulator 90 back to primary regulator 42.

Like transfer relay 50, transfer relay 60 is conventional and is movable between two conditions of operation, whereby in the first condition side 60A is closed and side 60B is open, and in the second condition side 60A is open and side 60B is closed. Like any conventional transfer relay, transfer relay 60 incorporates a magnetic coil. To set transfer relay 60 in its first condition, which corresponds to the primary mode of operation of transfer relay 60 in conjunction with lighting system 20, the polarity across a magnetic coil of transfer relay 60 is set such that side 60A is closed and side 60B is open. To move transfer relay 60 from its first condition to its second condition corresponding to the standby mode of operation of transfer relay 60 in conjunction with lighting system 20, the polarity across a magnetic coil of transfer relay 60 is changed opening side 60A and closing side 60B. To move transfer relay 60 from its second condition back to its first condition corresponding to the primary mode of operation of transfer relay 60 in conjunction with lighting system 20, the polarity across a magnetic coil of transfer relay 60 is changed closing side 60A and opening side 60B. Further details of transfer relay 60 will readily occur to the skilled artisan and will not be discussed.

With respect to series circuit 32, transfer relay 70 is movable between primary and standby modes of operation. The primary mode of operation of transfer relay 70 is side 70A of transfer relay 70 closed directing lighting power to airfield series loop 45 from primary regulator 44, and side 70B of transfer relay 70 open isolating standby regulator 90 from series circuit 32 and airfield series loop 45. The standby mode of operation of transfer relay 70 is side 70B of transfer relay 70 closed directing lighting power to airfield series loop 45 from standby regulator 90, and side 70A of transfer relay 70 open isolating primary regulator 44 from airfield series loop 45. In the standby mode of operation of transfer relay 70, standby regulator 90 directs lighting power to airfield series loop 45 allowing primary regulator 44 to be serviced without interrupting the operation of series loop 45. After servicing of primary regulator 44 is completed, transfer relay 70 may be moved from its standby mode of operation back to its primary mode of operation transferring lighting power to airfield series loop 45 from standby regulator 90 back to primary regulator 44.

Like transfer relays 50 and 60, transfer relay 70 is conventional and is movable between two conditions of operation, whereby in the first condition side 70A is closed and side 70B is open, and in the second condition side 70A is open and side 70B is closed. Like any conventional transfer relay, transfer relay 70 incorporates a magnetic coil. To set transfer relay 70 in its first condition, which corresponds to the primary mode of operation of transfer relay 70 in conjunction with lighting system 20, the polarity across a magnetic coil of transfer relay 70 is set such that side 70A is closed and side 70B is open. To move transfer relay 70 from its first condition to its second condition corresponding to the standby mode of operation of transfer relay 70 in conjunction with lighting system 20, the polarity across a magnetic coil of transfer relay 70 is changed opening side 70A and closing side 70B. To move transfer relay 70 from its second condition back to its first condition corresponding to the primary mode of operation of transfer relay 70 in conjunction with lighting system 20, the polarity across a magnetic coil of transfer relay 70 is changed closing side 70A and opening side 70B. Further details of transfer relay 70 will readily occur to the skilled artisan and will not be discussed.

With respect to series circuit 33, transfer relay 80 is movable between primary and standby modes of operation. The primary mode of operation of transfer relay 80 is side 80A of transfer relay 80 closed directing lighting power to airfield series loop 47 from primary regulator 46, and side 80B of transfer relay 80 open isolating standby regulator 90 from series circuit 33 and airfield series loop 47. The standby mode of operation of transfer relay 80 is side 80B of transfer relay 80 closed directing lighting power to airfield series loop 47 from standby regulator 90, and side 80A of transfer relay 80 open isolating primary regulator 46 from airfield series loop 47. In the standby mode of operation of transfer relay 80, standby regulator 90 directs lighting power to airfield series loop 47 allowing primary regulator 46 to be serviced without interrupting the operation of series loop 47. After servicing of primary regulator 46 is completed, transfer relay 80 may be moved from its standby mode of operation back to its primary mode of operation transferring lighting power to airfield series loop 47 from standby regulator 90 back to primary regulator 46.

Like transfer relays 50, 60, and 70, transfer relay 80 is conventional and is movable between two conditions of operation, whereby in the first condition side 80A is closed and side 80B is open, and in the second condition side 80A is open and side 80B is closed. Like any conventional transfer relay, transfer relay 80 incorporates a magnetic coil. To set transfer relay 80 in its first condition, which corresponds to the primary mode of operation of transfer relay 80 in conjunction with lighting system 20, the polarity across a magnetic coil of transfer relay 80 is set such that side 80A is closed and side 80B is open. To move transfer relay 80 from its first condition to its second condition corresponding to the standby mode of operation of transfer relay 80 in conjunction with lighting system 20, the polarity across a magnetic coil of transfer relay 80 is changed opening side 80A and closing side 80B. To move transfer relay 80 from its second condition back to its first condition corresponding to the primary mode of operation of transfer relay 80 in conjunction with lighting system 20, the polarity across a magnetic coil of transfer relay 80 is changed closing side 80A and opening side 80B. Further details of transfer relay 80 will readily occur to the skilled artisan and will not be discussed.

Figure 4:
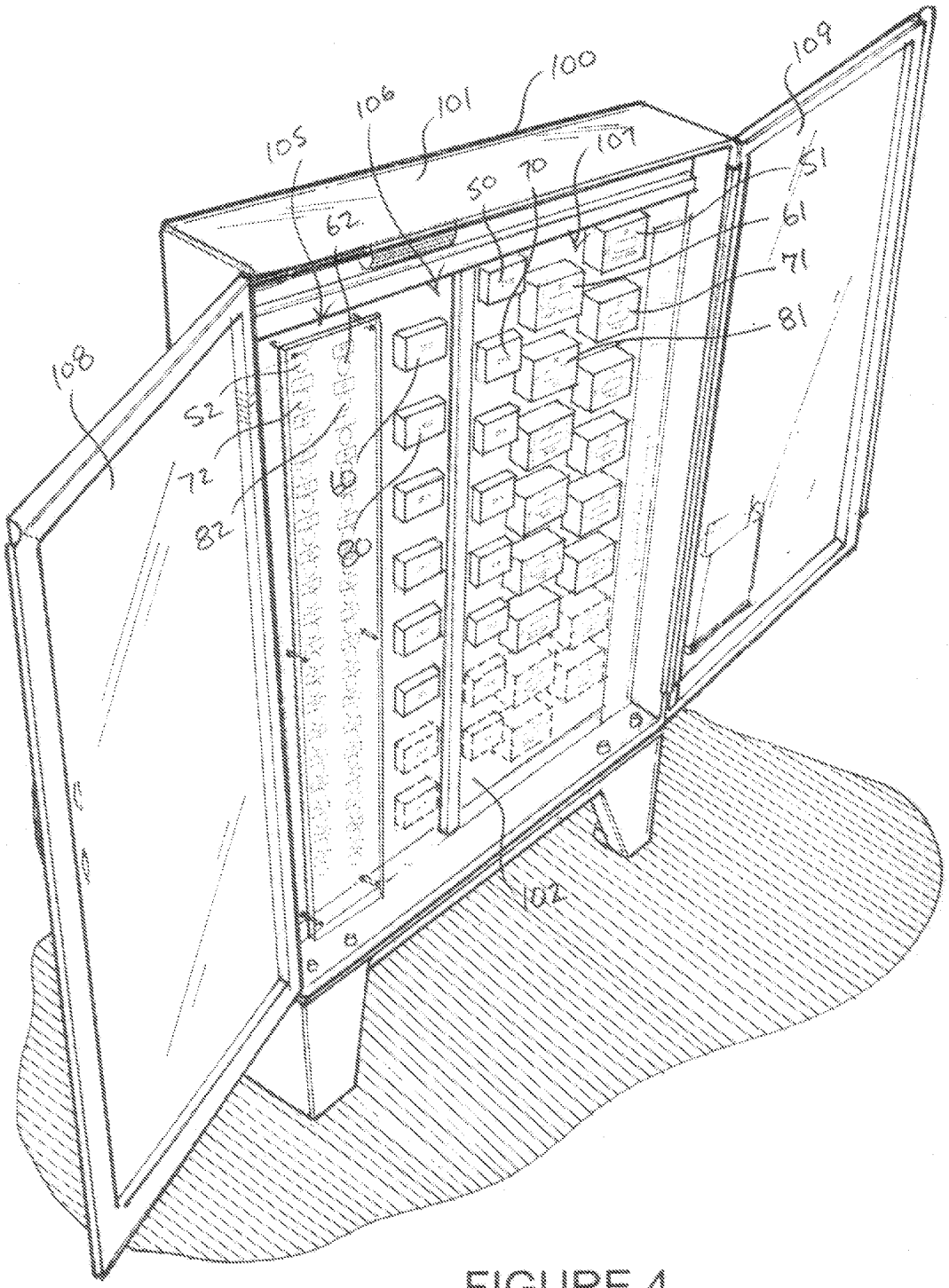
FIG. 4 is a perspective view of a cabinet of the airfield lighting system of FIG. 1 shown as it would appear open revealing appliances of the airfield lighting system including a bank of terminal blocks, a bank of transfer relays, and a bank of series plug cutouts.
Figure 5:
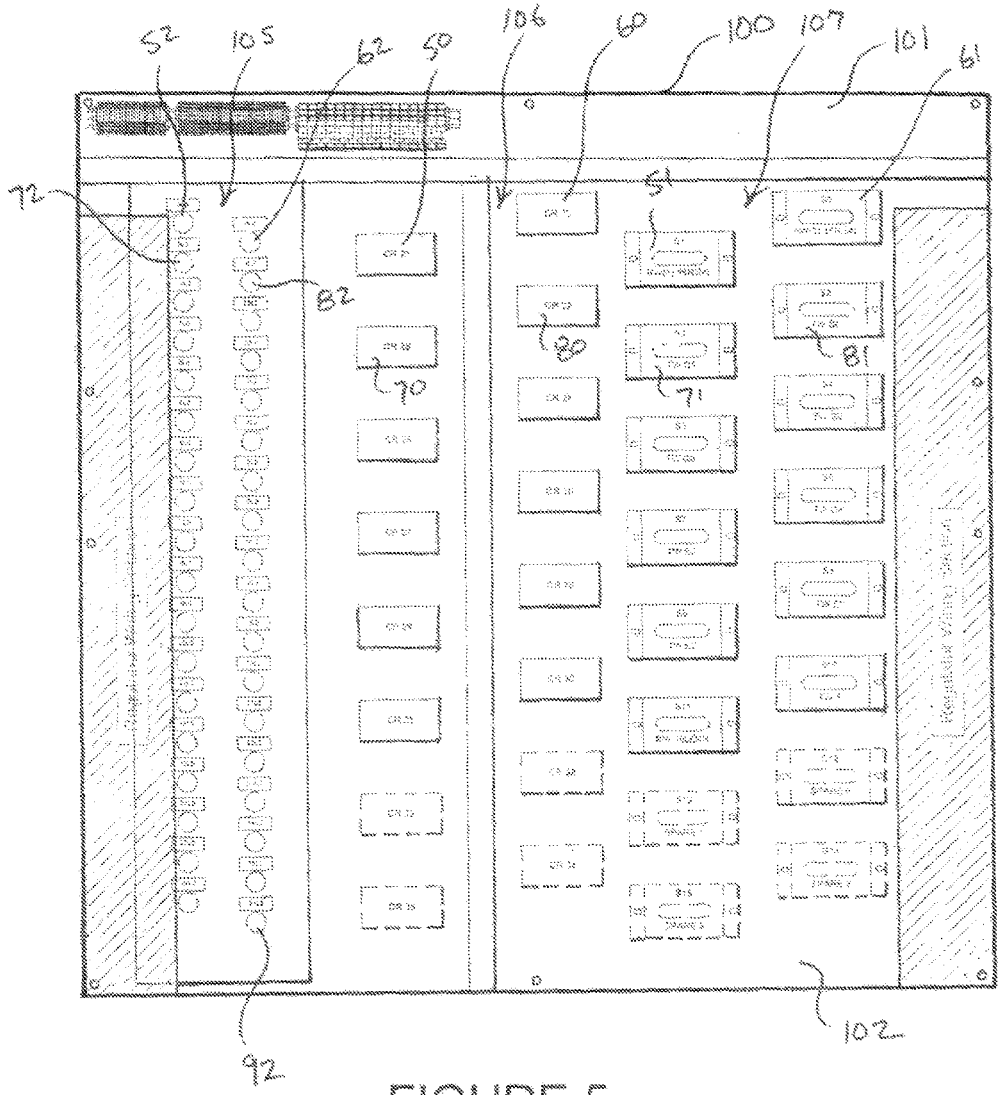
FIG. 5 is a schematic representation of the appliances of the cabinet illustrated in FIG. 4.

The circuit appliances of series circuits 30-33 are preferably maintained in a cabinet 100 illustrated in FIG. 4. Cabinet 100 consists of a secure vault, metal enclosure, or encasement 101 that maintains a large circuit board 102. Circuit board 102, which is also illustrated in FIG. 5, carries a bank 105 of terminal blocks, a bank 106 of transfer relays, and a bank 107 of series plug cutouts. Primary regulators 40, 42, 44, and 46 and standby regulator 90 are installed outside of cabinet 100, and are wired to their respective terminal blocks 52, 62, 72, 82, and 92 located in bank 105 with conventional electrical wiring, which are in turn wired to their respective transfer relays 50, 60, 70, and 80 located in bank 106 with conventional electrical wiring, and which are in turn wired to their respective SPCs 51, 61, 71, and 81 located in bank 107 with conventional electrical wiring. Cabinet 100 is furnished with doors 108 and 109, which may be opened as shown in FIG. 4 for accessing the appliances maintained therein, and closed and locked for securing the appliances maintained therein.

Looking back to FIG. 2, cabinet 100 is located and installed at an installation site 110 adjacent to airfield 10. In the present embodiment, a secured utility building installation 111 is installed at airfield 10, within which cabinet 100 is housed and which defines installation site 110. Cabinet 100, and the appliances it contains, is preferably manufactured offsite, transported to installation site 110 and installed in place within building installation 111 defining installation site 110. Primary regulators 40, 42, 44, and 46 and standby regulator 90 are housed within building installation 111 defining installation site 110, and are wired to their respective terminal blocks 52, 62, 72, 82, and 92 (shown in FIG. 3) maintained by cabinet 100 with conventional electrical wiring. The SPCs 51, 61, 71, and 82 (shown in FIG. 3) are then, in turn, wired to their respective series loops 41, 43, 45, and 47 with conventional electrical wiring, thereby completing the installation of lighting system 20 according to the principles of the invention at which point lighting system 20 may be used according to the discussion set forth above.

Cabinet 100 is floor-mounted in the preferred embodiment set forth herein. It may, if desired, be a wall-mounted cabinet or other suitable cabinet form.

Lighting system 20 incorporates provisions for local and/or remote control methods. Remote controls are recommended for locations served by a control tower, flight service station, or other manned offices where the system(s) operate. Local controls may be designed using direct switching at or near cabinet 100 or automatic controls, with provisions for switching between automatic and manual control. Remote controls may be designed using a fixed-wire method or radio control.

And so the operation and control of lighting system 20 is therefore carried out with a control system 120, which is coupled in signal communication to series circuits 30-33 and used to control and monitor the operation of series circuits 30-33 including the operation of transfer relays 50, 60, 70, and 80. Control system 120 is, in the present embodiment, denoted in FIG. 2 and is located at installation site 110 in building installation 111. In this instance, control system 120 is a local system. However, it can, if desired, be provided as a remote system, if desired, without departing from the invention, whereby it may be located at a control tower, flight service station, or other manned office. Control system 120 is conventional, incorporates conventional logic, and is used to control and monitor the operation of series circuits 30-33, and is used to switch transfer relays 50, 60, 70 and 80 between their primary and standby modes of operation.

Figure 6:
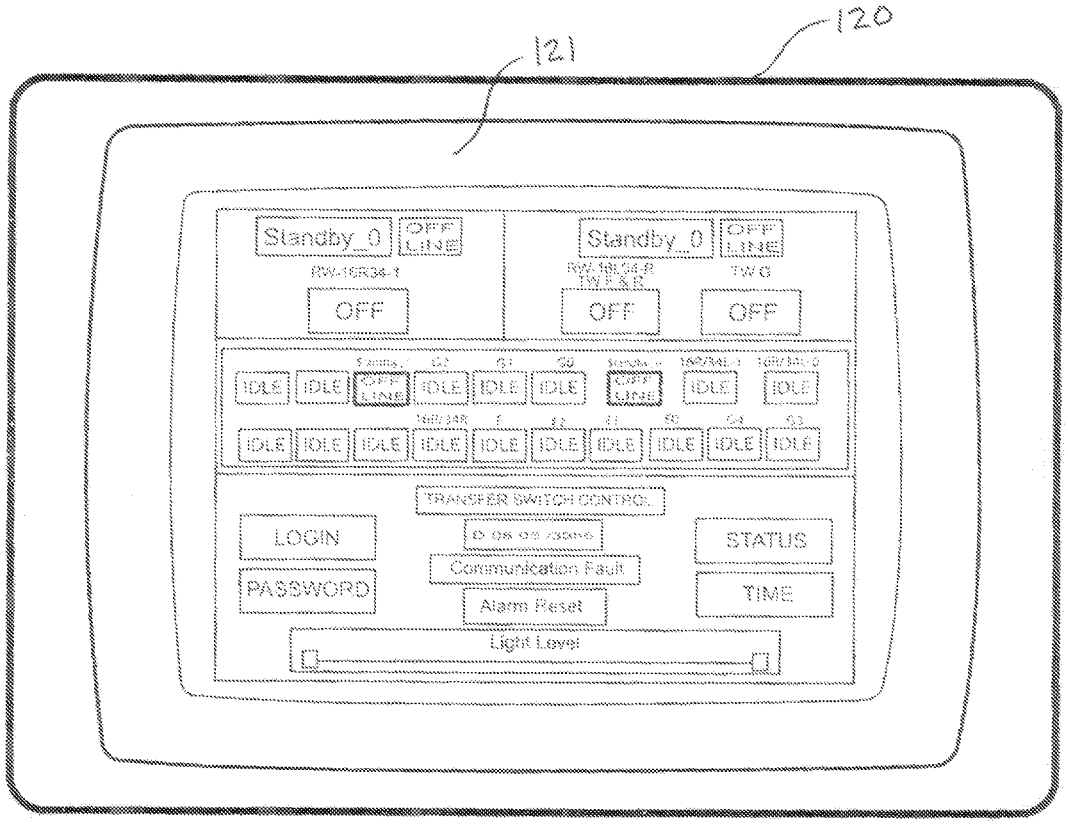
FIG. 6 is a control panel of a control system useful in conjunction with an airfield lighting system constructed and arranged in accordance with the principle of the invention.

FIG. 6 is an example of a control panel 121 of control system 120 that may be used to interface with series circuits 30-33 to monitor and control the operation of series circuits 30-33. For each of series circuits 30-33, control panel 121 is used to select the primary regulator to be taken offline, and is used to switch the associated transfer relay from its primary mode of operation to its standby mode of operation transferring lighting power from the primary regulator to standby regulator 90 for allowing the primary regulator to be serviced without interrupting the operation of the associated series loop, and then after servicing of the primary regulator is complete switching the transfer relay from its standby mode of operation to its primary mode of operation transferring lighting power from standby regulator 90 back to the primary regulator, in accordance with the principle of the invention.

Standby regulator 90 is provided to service series circuits 30-33. When standby regulator 90 is powering a series loop of one of series circuits 30-33 for the purpose of allowing the primary regulator thereof to be serviced, it is dedicated to servicing that particular series loop and may not be used to concurrently service another series loop. In other words, standby regulator 90 can only be used with one series circuit at any given time. Although standby regulator 90 is used to service each of series circuits 30-33, more standby regulators can be provided if desired, each for serving one or more of series circuits 30-33, and series circuits 30-33 may each incorporate their own dedicated standby regulator, if desired.

A lighting system constructed and arranged in accordance with the principle of the invention may incorporate any number of series circuits, and any number of standby regulators. As a matter of example as shown in FIGS. 4 and 5, bank 105 incorporates numerous terminal blocks in addition to terminal blocks 52, 62, 72, and 82, bank 106 incorporates numerous transfer relays in addition to transfer relays 50, 60, 70, and 80, and bank 106 incorporates numerous SPCs in addition to SPCs 51, 61, 71, and 81. This provision allows for scalability, whereby cabinet 100 may be used with additional series circuits as the number of series circuit grows with the grow of the airfield incorporating lighting system 20.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An airfield lighting system, comprising:

an airfield series circuit including a transfer relay having first and second sides, and a primary regulator operatively coupled to an airfield series loop of an airfield at the first side of the transfer relay;

a standby regulator operatively coupled to the airfield series circuit at the second side of the transfer relay;

the transfer relay movable between primary and standby modes of operation;

the primary mode of operation comprising the first side of the transfer relay closed directing lighting power to the airfield series loop from the primary regulator, and the second side of the transfer relay open isolating the standby regulator from the airfield series circuit; and the standby mode of operation comprising the second side of the transfer relay closed directing lighting power to the airfield series loop from the standby regulator, and the first side of the transfer relay open isolating the primary regulator from the airfield series circuit.

2. The airfield lighting system according to claim 1, further comprising a series plug cutout coupled to the airfield series circuit between the transfer relay and the airfield series loop.

3. The airfield lighting system according to claim 1, further comprising a cabinet housing the primary and standby regulators, the transfer relay, and the series plug cutout.

4. The airfield lighting system according to claim 1, further comprising a control system operatively coupled to the transfer relay for moving the transfer relay between the primary and standby modes of operation.

5. The airfield lighting system according to claim 3, wherein the cabinet is located at an installation site adjacent to the airfield.

6. An airfield lighting system, comprising:

a first airfield series circuit including a first transfer relay having first and second sides, and a first primary regulator operatively coupled to a first airfield series loop of an airfield at the first side of the first transfer relay;

a second airfield series circuit including a second transfer relay having first and second sides, and a second primary regulator operatively coupled to a second airfield series loop of the airfield at the first side of the second transfer relay;

a standby regulator operatively coupled to the first airfield series circuit at the second side of the first transfer relay, and to the second airfield series circuit at the second side of the second transfer relay;

the transfer relay movable between primary and standby modes of operation respecting the first and second airfield series circuits;

with respect to the first airfield series circuit:

the primary mode of operation comprising the first side of the first transfer relay closed directing lighting power to the first airfield series loop from the first primary regulator, and the second side of the first transfer relay open isolating the standby regulator from the first airfield series circuit, and the standby mode of operation comprising the second side of the first transfer relay closed directing lighting power to the first airfield series loop from the standby regulator, and the first side of the first transfer relay open isolating the first primary regulator from the first airfield series circuit; and with respect to the second airfield series circuit:

the primary mode of operation comprising the first side of the second transfer relay closed directing lighting power to the second airfield series loop from the second primary regulator, and the second side of the second transfer relay open isolating the standby regulator from the second airfield series circuit, and the standby mode of operation comprising the second side of the second transfer relay closed directing lighting power to the second airfield series loop from the standby regulator, and the first side of the second transfer relay open isolating the second primary regulator from the second airfield series circuit.

7. The airfield lighting system according to claim 6, further comprising a first series plug cutout coupled to the first airfield series circuit between the first transfer relay and the first airfield series loop.

8. The airfield lighting system according to claim 7, further comprising a second series plug cutout coupled to the second airfield series circuit between the second transfer relay and the second airfield series loop.

9. The airfield lighting system according to claim 8, further comprising a cabinet housing the first and second primary regulators, the standby regulator, the first and second transfer relays, and the first and second series plug cutouts.

10. The airfield lighting system according to claim 6, further comprising a control system operatively coupled to the first and second transfer relays for moving the first and second transfer relays between the primary and standby modes of operation, respectively.

11. The airfield lighting system according to claim 9, wherein the cabinet is located at an installation site adjacent to the airfield.

12. A method comprising steps of:

providing an airfield series circuit including a transfer relay having first and second sides and movable between primary and standby modes of operation, and a primary regulator operatively coupled to an airfield series loop of an airfield at the first side of the transfer relay;

providing a standby regulator;

operatively coupling the standby regulator to the airfield series circuit at the second side of the transfer relay;

the primary mode of operation comprising the first side of the transfer relay closed directing lighting power to the airfield series loop from the primary regulator, and the second side of the transfer relay open isolating the standby regulator from the airfield series circuit; and the standby mode of operation comprising the second side of the transfer relay closed directing lighting power to the airfield series loop from the standby regulator, and the first side of the transfer relay open isolating the primary regulator from the airfield series circuit.

13. The method according to claim 12, further comprising placing the transfer relay in the primary mode of operation directing lighting power to the airfield series loop from the primary regulator and isolating the standby regulator from the airfield series circuit.

14. The method according to claim 12, further comprising placing the transfer relay in the standby mode of operation directing lighting power to the airfield series loop from the standby regulator and isolating the primary regulator from the airfield series circuit.

15. The method according to claim 14, further comprising servicing the primary regulator.

16. The method according to claim 15, further comprising:

completing the step of servicing the primary regulator; and placing the transfer relay in the primary mode of operation directing lighting power to the airfield series loop from the primary regulator and isolating the standby regulator from the airfield series circuit.

17. The method according to claim 12, further comprising: providing a series plug cutout; and coupling the series plug cutout coupled to the airfield series circuit between the transfer relay and the airfield series loop.

18. The method according to claim 17, further comprising: providing a cabinet; and housing the primary and standby regulators, the transfer relay, and the series plug cutout in the cabinet.

19. The method according to claim 18, further comprising installing the cabinet at an installation site adjacent to the airfield.

* * * * *